US008137164B2

(12) United States Patent
Boeck et al.

(10) Patent No.: US 8,137,164 B2
(45) Date of Patent: Mar. 20, 2012

(54) GUARD DEVICE

(75) Inventors: Cornelius Boeck, Kirchheim (DE); Joachim Schadow, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 412 days.

(21) Appl. No.: 12/444,196

(22) PCT Filed: Jun. 6, 2008

(86) PCT No.: PCT/EP2008/057065

§ 371 (c)(1),
(2), (4) Date: Apr. 3, 2009

(87) PCT Pub. No.: WO2009/015929

PCT Pub. Date: Feb. 5, 2009

(65) Prior Publication Data

US 2009/0266214 A1 Oct. 29, 2009

(30) Foreign Application Priority Data

Jul. 30, 2007 (DE) ..... 10 2007 035 704

(51) Int. Cl.
*B24B 55/04* (2006.01)

(52) U.S. Cl. ..... 451/454; 451/457

(58) Field of Classification Search ..... 451/451, 451/454, 457, 452

See application file for complete search history.

(56) References Cited

U.S. PATENT DOCUMENTS

| | | | | | |
|---|---|---|---|---|---|
| 3,129,537 | A | * | 4/1964 | Backer | 451/363 |
| 3,571,983 | A | * | 3/1971 | Stewart et al. | 451/452 |
| 3,638,364 | A | * | 2/1972 | Grove et al. | 451/452 |
| 3,694,971 | A | * | 10/1972 | Renner et al. | 451/450 |
| 3,808,749 | A | * | 5/1974 | Rosberg et al. | 451/452 |
| 3,902,286 | A | * | 9/1975 | Matson | 451/452 |
| 5,862,594 | A | | 1/1999 | Soderqvist | |
| 6,464,573 | B1 | | 10/2002 | Keller | |
| 7,261,624 | B2 | | 8/2007 | Wedel et al. | |

FOREIGN PATENT DOCUMENTS

| | | |
|---|---|---|
| DE | 197 19 461 | 11/1997 |
| DE | 101 30 048 | 3/2002 |
| DE | 201 09 169 | 10/2002 |
| DE | 10 2005 044 298 | 5/2006 |

* cited by examiner

*Primary Examiner* — Dung Van Nguyen
(74) *Attorney, Agent, or Firm* — Michael J. Striker

(57) ABSTRACT

A guard device (10) for handheld power tools with a disklike and rotating tool (12) includes a base body (14) formed by a platelike element (30) having a semicircular embodiment formed as a peripheral region (32). A guard rim is disposed on the peripheral region (32) and has a portion (36) oriented perpendicular to the platelike element (30) and a further portion (38) oriented parallel to the platelike element (30). An energy absorption element (16) is coupled to the base body (14) via a coupling and located between the portion (38) and the platelike element (30). The coupling is embodied fixedly in normal operation and enables in an emergency mode enables a rotary motion of the energy absorption element (16) relative to the base body (14).

14 Claims, 3 Drawing Sheets

GUARD DEVICE

CROSS-REFERENCE

The invention described and claimed hereinbelow is also described in PCT/EP2008/057065, filed on Jun. 6, 2008 and DE 10 2007 035 704.6, filed on Jul. 30, 2007. This German Patent Application, whose subject matter is incorporated here by reference, provides the basis for a claim of priority of invention under 35 U.S.C. 119 (a)-(d).

BACKGROUND OF THE INVENTION

The invention is based on a guard device.

From German Utility Model DE 201 09 169 U1, a guard device is known, in particular for handheld power tools having a disklike and rotating tool that has a base body.

SUMMARY OF THE INVENTION

The invention is based on a guard device, in particular for handheld power tools with a disklike and rotating tool, having a base body.

It is proposed that the guard device has an energy absorption element, which is coupled to the base body via a coupling that is embodied fixedly in normal operation and that in an emergency mode enables at least a rotary motion of the energy absorption element relative to the base body. The coupling is effected at at least one coupling point or at least one coupling region, and the rotary motion ensues inside the coupling point or inside the coupling region. In this connection, the term "normal operation" should be understood to mean an operating mode of a handheld power tool in which only energy from parts coming into contact with the energy absorption element acts, up to a predetermined value, on the energy absorption element. The term "emergency mode" should be understood to mean an operating mode of the handheld power tool in which energy from parts coming into contact with the energy absorption element acts on the energy absorption element above the predetermined value. The guard device, including the base body and the energy absorption element, is preferably located around a disklike and rotating tool of a handheld power tool, such as a right-angle sander, so that by means of the guard device, in the operation of the handheld power tool, sparks and/or particles of material and/or particularly rotating fragments, and/or fragments spun outward with great force, from a disk that has burst during operation, such as a sanding wheel, cutting wheel, and the like, can advantageously be braked, or an energy, in particular the kinetic energy of the particles, can be reduced. The base body, in a region at risk, is coupled to the energy absorption element by suitable provisions in such a way that the energy absorption element, on being struck by fragments of the tool, absorbs energy, in that the energy absorption element executes a rotary motion relative to the base body. In this connection, the term "energy absorption element" should be understood to mean an element which because of its material properties and the manner of its coupling to the base body can absorb energy especially well, especially kinetic energy, such as rotational energy, translational energy, heat, and so forth, from parts that come into contact with the energy absorption element. Thus by means of the energy absorption element, a buffer zone on the base body can advantageously be attained, and as a result, the base body can advantageously be protected. In addition, the energy absorption element lessens the tendency of the base body to rotate under an abruptly occurring exertion of force, because the great material strength of the energy absorption element prevents the burst tool parts from penetrating the base body and digging into it. The energy absorption element, which is preferably made from a tough material that is hard to destroy thus has the task of absorbing some of the energy that suddenly strikes the energy absorption element when the tool bursts, and of protecting the base body from damage. As a result, the risk of injury to a user of the handheld power tool can advantageously be averted.

It is proposed that the coupling be done via a force-locking, form-locking and/or material-locking connection between the base body and the energy absorption element. In a force-locking connection, for instance, a friction lock at partial points is generated by means of a press fit as the result of a reshaping operation on the joined-together parts of the guard device. After the energy surge is introduced when the tool bursts, the static friction between the base body and the energy absorption element is overcome, and the two components can advantageously execute a relative motion to one another by a defined angular range. A certain proportion of the energy is absorbed as a result, and the speed of the fragments emerging from the guard device is lowered. The force-locking connection can be established especially simply and economically. In the case of a form-locking connection, the connection of the base body and the energy absorption element is effected as toothing, for example. Advantageously, the toothing first prevents a displacement of the energy absorption element relative to the base body in the radial direction. However, the energy surge that suddenly occurs when the tool breaks causes an elastic or plastic deformation of this toothing and then advantageously allows a motion of the energy absorption element within an angular range. In the case of a material-locking connection, the two guard device parts are joined together by means of adhesive bonding, joining, welding, and so forth, in such a way that the energy that suddenly occurs when the tool breaks causes the material-locking connection to be undone, and as a result, advantageously, the relative motion of the energy absorption element and the base body can ensue. No additional securing means are necessary for the purpose.

It is also proposed that the connection has at least one rated breaking point and/or at least one rated breaking region. In this connection, the term "rated breaking point" or "rated breaking region" should be understood to mean a coupling point or coupling region which is disconnected at a predetermined load on the guard device. By means of the rated breaking point or the rated breaking region, it is advantageously attained that an overload on the guard device and resultant greater damage are averted.

Advantageously, the rated breaking point and/or the rated breaking region is designed such that when an energy surge with a predetermined value is introduced into the energy absorption element, the rotary motion of the energy absorption element relative to the base body ensues. As a result, in normal operation, that is, at an energy surge below the predetermined value, the energy absorption element is fixedly coupled to the base body, and not until the emergency mode, or in other words an energy surge above the predetermined value, does it execute a rotary motion relative to the base body.

It is also proposed that the energy absorption element is embodied as a rim. As a result, the energy absorption element can be limited to a region which is preferentially struck by sparks, particles of material, and/or fragments of burst tools during the operation of a handheld power tool.

It is furthermore proposed that the energy absorption element is adapted to a rim of the base body. The term "rim of the base body" should be understood here to mean a portion of the base body that is oriented parallel to a thickness of a tool, in particular a sanding or cutting wheel and is located around the tool on the base body in the circumferential direction. As a result, an especially stable embodiment of the energy absorption element on the base body is attained, since the base body thus additionally braces the energy absorption element.

Advantageously, the energy absorption element, together with the base body, covers an angular range of a tool of 180°. As a result, for a user of a handheld power tool with the guard device, especially effective shielding against sparks, particles of material, and/or fragments of a burst tool that move radially outward at high energy is achieved.

BRIEF DESCRIPTION OF THE DRAWINGS

Further advantages will become apparent from the ensuing description of the drawings. In the drawings, one exemplary embodiment of the invention is shown. The drawings, description and claims include numerous characteristics in combination. One skilled in the art will expediently consider the characteristics individually as well and put them together to make useful further combinations.

Shown are.

DETAILED DESCRIPTION OF THE EXEMPLARY EMBODIMENTS

Figure 1:
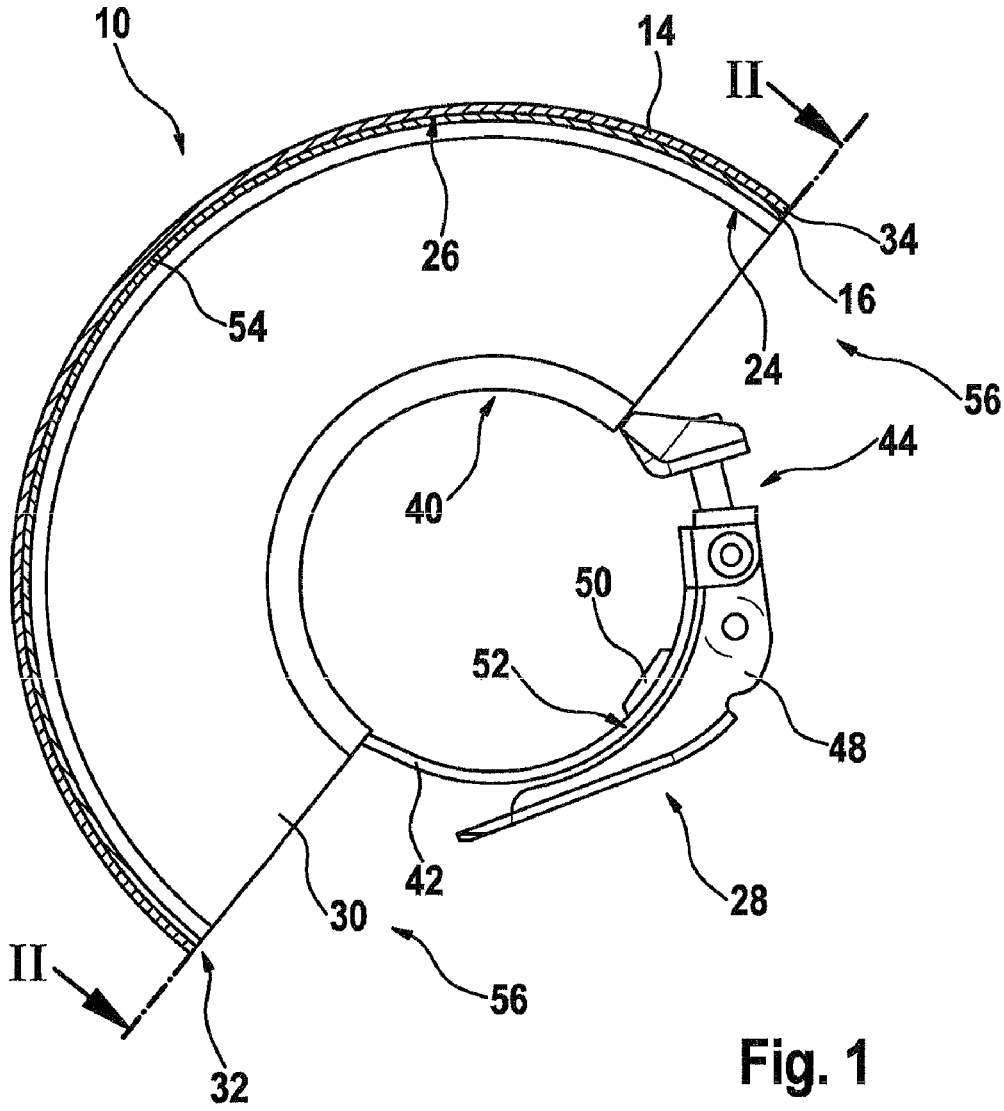
FIG. 1, a guard device of the invention, with a base body and an energy absorption element, in a sectional view.
Figure 2:
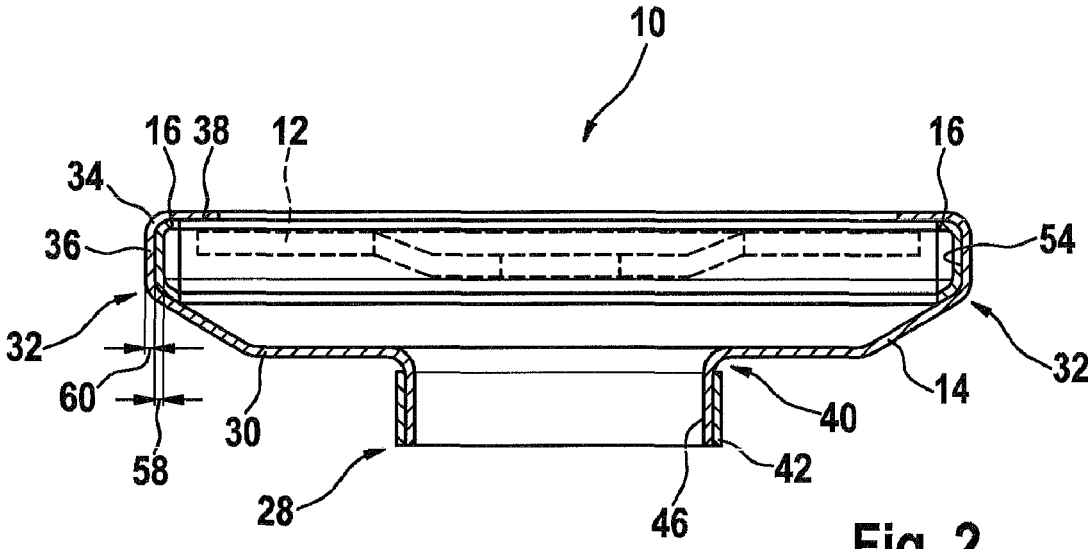
FIG. 2, a section through the guard device of FIG. 1 along the line II-II.

FIG. 1, in a sectional view, shows a guard device 10 according to the invention, specifically in the form of a guard hood, which is provided for a handheld power tool, not further identified here, such as a right-angle sander, that has a disklike and rotating tool 12 (FIG. 2). The guard device 10 includes a base body 14 and a securing device 28.

The base body 14 is intended to protect a user of the handheld power tool against sparks and/or particles of material that occur in operation of the handheld power tool. To that end, the base body 14 is formed by a platelike element 30, which has a semicircular embodiment; the platelike element 30 covers an angular range of approximately 180° of the tool 12 (FIG. 2). In the present exemplary embodiment, the element 30 comprises sheet steel. However, it may also comprise a suitable naturally hard aluminum forging alloy, which is used particularly whenever weight is to be reduced. Fundamentally, however, still other materials that appear useful to one skilled in the art and that have sufficient strength and hardness, such as a carbon fiber construction, are conceivable for an embodiment of the base body 14.

In a peripheral region 32, oriented radially outward, of the platelike steel sheet 30, a guard rim 34 embodied as a rim is located on the base body 14 and is initially oriented perpendicular to the platelike steel sheet 30 (FIG. 2). A portion 36 of the guard rim 34 oriented perpendicular to the platelike steel sheet 30 is adjoined perpendicular to it by a further portion 38 of the guard rim 34, which is additionally oriented parallel to the platelike steel sheet 30 (FIG. 2). The further portion 38 of the guard rim 34 furthermore extends radially inward. The two portions 36, 38 of the guard rim 34 and the platelike steel sheet 30 are made in one piece by a sheet reshaping process.

The securing device 28 (FIGS. 1 and 2) is located on the base body 14, in a radially inward-oriented peripheral region 40, diametrically opposite the tool 12, of the platelike steel sheet 30. The securing device 28 includes a tension belt 42, which is made from spring steel, and a tension unit 44. The tension belt 42 is embodied annularly and located around a semicircular rim 46 of the base body 14, and the semicircular rim 46 is embodied perpendicular to the platelike steel sheet 30 of the base body 14 (FIGS. 1 and 2). The semicircular rim 46 of the base body 14 and the platelike steel sheet 30 are made in one piece by a sheet-metal reshaping process (FIG. 2). The tension belt 42 is preferably welded to the base body 14. Fundamentally, still other connections that appear useful to one skilled in the art between the tension belt 42 and the base body 14 are conceivable, such as a connection by a pressure-joining process, and so forth.

The annular tension belt 42 is tensed, with the aid of the tension unit 44, about a receptacle region, not identified by reference numeral, of a handheld power tool in that a circumference of the annular tension belt 42, together with the tension unit 44, is shortened or widened. In the tension unit 44 shown in the exemplary embodiment, the connection of the base body 14 and the handheld power tool is locked in permanent fashion with the aid of a tension lever 48 embodied as a hinge.

In addition, the annular tension belt 42, in the region of the tension unit 44, has a riblike locking element 50, which extends along a portion 52 of the annular tension belt 42 (FIG. 1) and engages a recess, not visible here, on a tension neck of the handheld power tool. The riblike locking element 50 is intended for locking the base body 14, so that the base body 14 is located in a manner fixed against relative rotation around the disklike and rotating tool 12 of the handheld power tool. In addition, via a coding function, the locking element 50 assures an intended association of the guard device 10 relative to the handheld power tool.

However, the connection of the base body 14 to the handheld power tool can also be made via a screw connection, not shown here, between the tension belt 42 and a drive flange, likewise not shown here, of the handheld power tool. In addition, a nublike element, also not shown, on the tension belt 42 engages a recess on the flange of the right-angle sander and by this form lock prevents rotation of the guard hood on the flange. In principle, all provisions that appear useful to one skilled in the art and that prevent rotation of the guard device 10 relative to the handheld power tool in every case are possible.

According to the invention, between the portion 38 of the guard rim 34 and the platelike steel sheet 30, along the semicircular embodiment of the steel sheet 30, an energy absorption element 16 (FIGS. 1 and 2) is located in an inside 54, oriented toward the tool 12, of the portion 36 of the guard rim 34, and this energy absorption element is coupled to the base body 14; the coupling is embodied fixedly in normal operation, while in the emergency mode it enables at least a rotary motion of the energy absorption element 16 relative to the base body 14. The energy absorption element 16 is adapted to a rim 26 of the base body 14 and conforms with complementary contours, preferably as a channel-shaped profile section, to the inside 54 of the portion 36, in an angular region that is predetermined by the base body 14. The energy absorption element 16 is preferably embodied as an internal guard hood. It is embodied as a rim 34, which extends along the guard rim 34 of the base body 14 (FIG. 1). Preferably, the energy absorption element 16, like the base body 14, is also of sheet steel. Alternatively, the energy absorption element 16 may be formed at least in part by a harder material than the sheet steel 30 of the base body 14, such as a steel foam, or the energy absorption element 16 can at least in part also be formed by a softer material than the sheet steel 30 of the base body 14, so that effective absorption of sparks and/or particles of material by the energy absorption element 16 ensues. In principle, still other materials that appear useful to one skilled in the art are conceivable for the energy absorption element. It is furthermore conceivable for the energy absorption element 16 to be capable of executing further motions relative to the base body 14 both in normal operation and in the emergency mode. In the present exemplary embodiment, a thickness 58 of the energy absorption element 16 is embodied as at least partially less than a thickness 60 of the base body 14. Together with the base body 14, the energy absorption element 16 covers an angular range of 1800 of the disklike and rotating tool 12 of the handheld power tool (FIG. 1).

In the emergency mode of operation, for instance if the tool 12 bursts, the resultant fragments are spun with high kinetic energy onto the annular inner region of the guard device 10, or the inside of the energy absorption element 16. The force of the impact creates a force striking in the tangential direction, which has the tendency to rotate the energy absorption element 16 out of its position in a radial direction. As a result of the rotation of the energy absorption element 16 relative to the base body 14 by an angular amount determined in advance by experiments, some of the kinetic energy of the fragments is absorbed. The fragments of the burst disklike tool 12 are braked and emerge at reduced speed from an open region 56 of the guard device 10.

To ascertain the most favorable angle of rotation of the energy absorption element 16 relative to the base body 14 for the guard device 10, the following parameters must be taken into account in experiments: namely, the diameter of the disklike tool 12, the mass of the tool 12, the operating rpm of the tool 12, the force at the connection point between the energy absorption element 16 and the base body 14, and the size of the tool parts that occur upon breakage.

The coupling of the energy absorption element 16 to the base body 14 is done via a force-locking, form-locking and/or material-locking connection. The connection has at least one rated breaking point and/or at least one rated breaking region. The rated breaking point and/or the rated breaking region is designed such that when an energy surge at a predetermined value is introduced into the energy absorption element 16, the rotary motion of the energy absorption element 16 relative to the base body 14 ensues.

Figure 3:
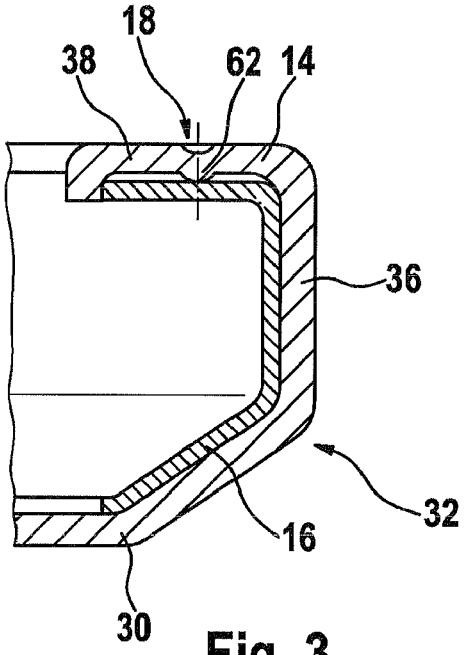
FIG. 3, a fragmentary section of the guard device, with a connection of the base body and energy absorption element, in a first embodiment.

FIG. 3 shows a connection which is embodied as a clamp connection 18. This is a force-locking connection that is effected by friction locking. Between the base body 14 and the energy absorption element 16, a press-fit connection of the two parts 14, 16 to one another is established by means of a reshaping operation of the base body 14, in that bosses 2 are provided at one or more points in the portion 38 of the base body 14. These bosses 62 may have various shapes, such as round, elliptical, lenticular, and/or rodlike. They may, as shown in the sectional view in FIG. 3, be embodied only in the portion 38 of the base body 14, or in other portions 30, 32, 36 of the base body 14 as well, in the form of continued indentations.

Figure 4:
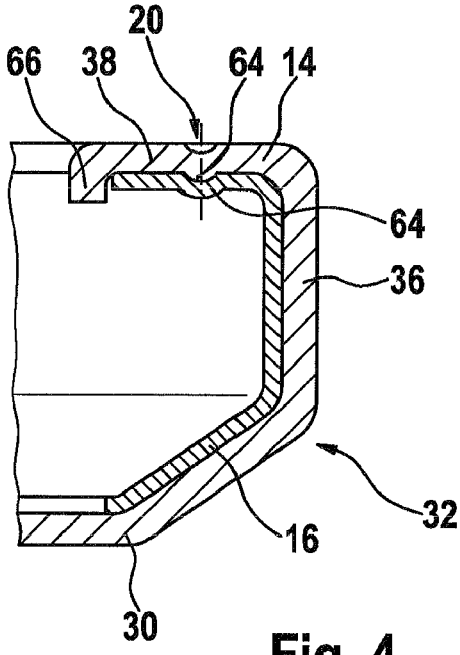
FIG. 4, a fragmentary view of the guard device with a connection, in a second embodiment.

FIG. 4 shows a connection which is embodied as a snap connection 20. In this case, bosses are embodied as integral moldings 64 on both components (the base body 14 and the energy absorption element 16). For rotating the components 14, 16 relative to one another, the energy released upon breakage of the tool 12 is needed, in order to effect an elastic deformation of the base body 14 and of the energy absorption element 16, or of the portion 38 of the guard device 10, and to displace the energy absorption element 16 radially.

However, it is also conceivable to place the bosses of FIGS. 1 through 4 in the circumferential region, that is, in the radial connection point between the two components 14, 16. One or more blocking teeth 66 mounted on the circumference of the open portion 38 prevent a change of position of the energy absorption element 16 in the axial direction.

Figure 5:
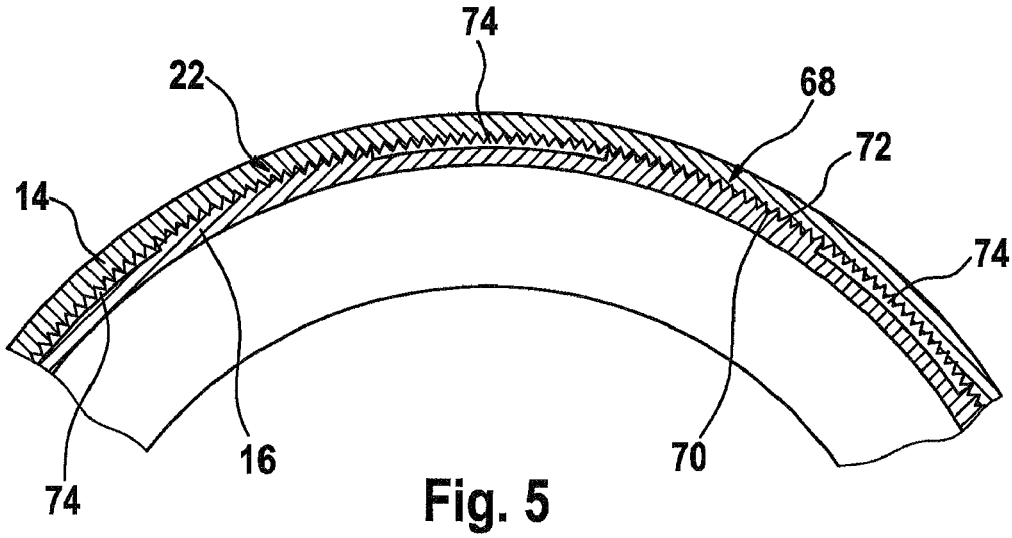
FIG. 5, a fragmentary section of the guard device, with a connection in a third embodiment.

FIG. 5 shows a connection which is embodied as toothing 22. In the present exemplary embodiment, the toothing 22 is selected to be in the form of knurling 68 with axially parallel scoring] or knurled teeth 70, 72 for the connection point of the two components 14, 16; that is, both the base body 14 and the energy absorption element 16 have knurled teeth 70, 72, which can mesh with one another. In this exemplary embodiment, the energy absorption element 16 has both segment like portions with knurled teeth 72 as well as segment like portions without knurled teeth 72, but with recesses 74, and the portions alternate. Thus portions with meshing knurled teeth alternate with portions without meshing knurled teeth. Rotation of the energy absorption element 16 relative to the base body 14 is possible only by shearing off the tips of the knurled teeth 72.

A further fundamental possibility of connection can be attained by the aid of suitable securing means, such as rivets, pins, or screws, preferably of soft materials. Form-locking connections are possible by means of adhesive bonds with suitable special adhesives. Steel constructions by welding are also conceivable, in which the two parts are joined together partially (for instance in spots). A relative motion between the base body and the energy absorption element can take place only if the energy surge that occurs when the tool breaks shears off the securing means or undoes the material-locking connections. In other words, the rated breaking point of a form-locking connection is designed to be sheared off, for instance. The shearing off of the securing means takes place at a predetermined force that acts on the securing means.

If different metals are combined, for instance if the base body 14 is of aluminum and the energy absorption element 16 is of sheet steel, no thermal connection can be made. In this instance, a pressure joining or pressure setting and joining process is a technological and economical alternative. Overlappingly arranged guard device parts are joined together by this method, without additional materials, by means of local cold forming in a single operation in such a way that only a defined energy surge is capable of undoing this connection. Otherwise, all possibilities that appear useful to one skilled in the art are conceivable for connecting the base body 14 to the energy absorption element 16 of the guard device 10.

The invention claimed is:

1. A guard device (10) for handheld power tools having a disklike and rotating tool (12), comprising:

a base body (14) formed by a platelike element (30) having a semicircular embodiment comprising a peripheral region (32), oriented radially outward, wherein a guard rim (34) formed as a rim is disposed on said peripheral region (32), said guard rim (34) having a portion (36) oriented perpendicular to the platelike element (30) and a further portion (38) oriented parallel to the platelike element (30); and at least one energy absorption element (16), which is coupled to the base body (14) via a coupling and located between the portion (38) and the platelike element (30), along the semicircular embodiment, at an inside (54) of the peripheral region (32) facing the disklike and rotating tool (12) in a mounted state of the disklike and rotating tool (12);

wherein the coupling is embodied fixedly in normal operation and wherein the coupling enables in an emergency mode at least a rotary motion of the energy absorption element (16) relative to the base body (14).

2. The guard device as defined in claim 1, wherein the coupling is made via a force-locking, form-locking and/or material-locking connection.

3. The guard device as defined in claim 2, wherein the connection is embodied as a clamp connection (18).

4. The guard device as defined in claim 2, wherein the connection is embodied as a snap connection (20).

5. The guard device as defined in claim 2, wherein the connection is embodied as toothing (22).

6. The guard device as defined in claim 2, wherein the connection has at least one rated breaking point and/or at least one rated breaking region.

7. The guard device as defined in claim 6, wherein the rated breaking point and/or the rated breaking region is designed such that when an energy surge with a predetermined value is induced into the energy absorption element (16), the rotary motion of the energy absorption element (16) relative to the base body (14) occurs, wherein the at least one rated breaking point and/or the at least one rated breaking region is formed by an element selected from the group consisting of knurled teeth (70, 72), rivets, pins, screws, adhesive bonds, and welding techniques, wherein said element is configured to permit rotary motion of the energy absorption element (16) relative to the base body (14) by shearing, due to an energy surge.

8. The guard device as defined in claim 1, wherein the energy absorption element (16) is embodied as a rim (24).

9. The guard device as defined in claim 1, wherein the energy absorption element (16) is adapted to a rim (26) of the base body (14).

10. The guard device as defined in claim 1, wherein the energy absorption element (16) together with the base body (14) covers an angular range of the tool (12) of 180°.

11. The guard device as defined in claim 1, further comprising a securing device (28), wherein the securing device (28) is located on the base body (14) in a radially-inwardly oriented peripheral region (40), diametrically opposite the disklike and rotating tool (12), of the platelike element (30).

12. The guard device as defined in claim 11, wherein the securing device (28) includes a tension belt (42) and a tension unit (44), wherein the tension belt (42) is located around a semicircular rim (46) of the base body (14) embodied perpendicular to the platelike element (30).

13. The guard device as defined in claim 1, wherein the energy absorption element (16) is embodied as a channel-shaped profile which conforms with complementary contours to an interior (54) of the portion (36), in an angular region that is predetermined by the base body (14).

14. The guard device as defined in claim 1, wherein the energy absorption element (16) is formed as an internal guard hood.

* * * * *